US007153623B2

(12) United States Patent
Akazawa et al.

(10) Patent No.: US 7,153,623 B2
(45) Date of Patent: Dec. 26, 2006

(54) IMAGE FORMING METHOD USING ELECTROPHOTOGRAHY, ELECTROPHOTOGRAPHIC TONER, AND MANUFACTURING METHOD THEREOF

(75) Inventors: Yoshiaki Akazawa, Nara (JP); Rika Hayashi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 311 days.

(21) Appl. No.: 10/688,949

(22) Filed: Oct. 21, 2003

(65) Prior Publication Data

US 2004/0081907 A1 Apr. 29, 2004

(30) Foreign Application Priority Data

Oct. 23, 2002 (JP) ..... 2002-308319

(51) Int. Cl.
*G03G 13/20* (2006.01)

(52) U.S. Cl. ..... 430/124; 430/111.4
(58) Field of Classification Search ..... 430/124, 430/111.4
See application file for complete search history.

(56) References Cited

U.S. PATENT DOCUMENTS 5,139,914 A * 8/1992 Tomiyama et al. ..... 430/108.3

FOREIGN PATENT DOCUMENTS

JP 06-230602 * 8/1994

OTHER PUBLICATIONS

Japanese Patent Office machine-assisted translation of JP 06-230602 (pub. Aug. 1994).*

* cited by examiner

*Primary Examiner*—Janis L. Dote
(74) *Attorney, Agent, or Firm*—Nixon & Vanderhye P.C.

(57) ABSTRACT

A color toner which enables sufficient image density and color reproduction with no influence of a printing surface at the time of forming an image, and further enables the formation with a small amount of toner of a sharp, high density image having almost the same evenness as that formed by surface printing. The thickness of a toner image that has been formed and fixed on a printing medium is controlled and the pigment concentration in the toner and the melting characteristics of the toner are properly designated, thereby allowing a sharp, high-density image to be obtained with a small amount of toner.

1 Claim, No Drawings

IMAGE FORMING METHOD USING ELECTROPHOTOGRAHY, ELECTROPHOTOGRAPHIC TONER, AND MANUFACTURING METHOD THEREOF

BACKGROUND OF THE INVENTION

1. Field of the Invention

The present invention relates to an electrophotographic toner for single- or double-component development used for developing an electric latent image or magnetic latent image by an image forming apparatus such as an electrophotographic copier and printer, and a method for manufacturing the same.

2. Description of Related Art

In recent years, new apparatuses in the field of electrophotography such as copiers and printers have been developed with the objects of reducing apparatus size, and speeding up operation time, and providing high-quality images. In terms of the size reduction, all processes of electrophotography including developing systems and fixing systems have been examined. However, regarding developers, it is desired that developer filling parts such as a toner hopper have lower capacity and a longer life. In order to realize these features, it is desirable to develop a novel toner enabling a large number of printings with a small amount of toner.

In terms of the provision of high-quality images, the following methods have been developed: a method for obtaining sharp images by controlling the particle size, the electric characteristics, or the like of a toner as a developer, or controlling the color properties of the toner such as color development, transparency, and masking (hiding) properties; and a method for obtaining high-density images by attempting to increase the content of a colorant in a toner. Also, surface printing that uses a liquid recording material (ink) is capable of providing high-density images having uniform quality with a reduced recording material thickness on a printing medium in comparison with the case of electrophotographic images. For full-color electrophotographic images, process color toners including yellow, magenta, and cyan toners are usually used in addition to black toner, and various colors are reproduced through printing by the combination of these color toners. Therefore, the recording material (toner) used for a print image causes differences in thickness depending on colors to be reproduced, and the reflection difference attributable to the thickness differences allows a user to apprehend the difference from images formed by surface printing. Hence, in order to obtain uniform, sharp, and high-quality images by electrophotography, it is necessary to form an image having less thickness and a desired image density.

The patent document (JP Patent Publication (Kokai) No. 9-114127 A (1997)) discloses that high image quality, high density, and suitability for development can be attained by optimizing toner particle diameter, pigment content, and toner deposition amount. However, merely increasing pigment concentration and optimizing particle size and deposition amount, though enabling a high optical density, do not solve problems in that full-color image formation is liable to deteriorate the chroma or decrease the reproduction range of a secondary color.

The patent document (JP Patent Publication (Kokai) No. 6-230602 A (1994)) suggests that a toner image is formed out of a magnetic toner containing at least a binder resin and a magnetic powder, and the toner image is fixed so that the height ($h_1$) of the toner image before fixation and the height ($h_2$) of the toner image after the fixation satisfy the condition of $2 \leqq h_1/h_2 \leqq 10$. The document 2 describes that a lower height of toner image after fixation can control the occurrence of stains on copied images. However, when the toner image has a low height, masking properties of the toner on a printing medium may be inferior or the toner image may be affected by irregularities of the surface of a printing medium such as paper, thus making it impossible, for example, to obtain a desired optical density.

SUMMARY OF THE INVENTION

The present invention enables the obtainment of a designated image density even when image formation is conducted with a small amount of toner, and in addition, has been made to prevent the formed image from retaining the reflection difference and particle state resulting from electrophotography, which are caused by thickness differences among toner layers of images formed for each color to be reproduced. Thus, it is an object to provide an image forming method that enables the obtainment of high-density images with a small amount of toner, and uniform and excellent color reproduction while contributing to the size reduction of an image forming apparatus. It is also an object to provide a toner suitably used for the image forming method and a manufacturing method of the toner.

As a result of intensive studies, the present inventors have found that the above object can be achieved by setting the thickness of a toner image after fixation on a monochromatic solid part on a printing medium to be within a specific range, thereby attaining the present invention.

Namely, the present invention provides a method of forming images by electrophotography, wherein an image of a monochromatic solid part is formed with the deposit amount (M) of the toner on a printing medium and the image after fixing on the printing medium has a toner layer thickness (h) that satisfies the following equation:

$$10M/\rho \leqq h \leqq 10M/A$$

wherein M represents the toner deposition amount on the printing medium ($mg/cm^2$) and is 0.4 or less, h represents the toner layer thickness (μm) of the image after fixing on the printing medium, ρ represents the true specific gravity ($g/cm^3$) of the toner and A represents the bulk density of the toner ($g/cm^3$).

According to the present invention, when the thickness (h) of the toner image after fixation in a monochromatic solid part on a printing medium is 10 M/ρ or more and 10 M/A or less, there is no influence attributable to light scattering in the image toner layer or irregularities of the printing medium, so that a high density image with excellent transparency can be obtained. When the thickness is greater than 10 M/A, a desired optical density cannot be obtained due to insufficient fixing strength caused by insufficient fusion state among intervals of image-forming toner particles or light scattering by interfaces of the particles. Further, when the thickness is less than 10 M/ρ, the desired optical density cannot be obtained due to influences of irregularities of the printing medium or by the reflection of the printing medium itself.

Moreover, while the toner amount on an image formed by conventional electrophotography is usually about 0.5 to 0.6 $mg/cm^2$ for a monochromatic solid part, a lower toner amount, 0.4 $mg/cm^2$ or less, enables the obtainment of desired image properties according to the present invention.

In the present invention, in order to sufficiently develop colors for image formation with a smaller toner amount, the toner preferably contains pigments as colorants at concentrations of 5% to 25% by weight. More preferably, the concentration of the pigments as colorants contained in the toner composition is 5% to 20% by weight. When the pigment concentration in the toner composition is less than 5% by weight, sufficient spectral reflectance characteristics necessary for developing colors cannot be obtained due to the thickness of the toner image layer covering the printing medium, so that a satisfactory optical density cannot be obtained. Further, when the concentration is greater than 20% by weight, the resin component to be fused during fixation decreases and thereby fixation characteristics deteriorate, so that a desired image state cannot be obtained or the reproduction of a secondary color deteriorates due to inferior transparency, which are not desired effects.

A toner to be used for the present invention is preferably designed to have a ½ flow softening point temperature (Tm) of 95° C. to 130° C. When the Tm is less than 95° C., the toner may have poor storage stability or may cause fusion with a charge-imparting member due to stresses or the like inside a developing apparatus, which are not desired effects. Further, when the Tm is greater than 130° C., problems may arise in that the fixability deteriorates due to insufficient melting or desired color properties cannot be obtained.

Methods for manufacturing the toner of the present invention include pulverizing methods wherein raw materials are mixed, melted, and kneaded for dispersion, and then pulverized to obtain the toner, as well as polymerization methods such as suspension methods, emulsion aggregation methods, and in-liquid drying methods, wherein particles are generated in an aqueous solution or a solvent. The toner can be obtained by any of these methods, but it is particularly preferable to obtain a sufficient dispersion state even with a large pigment content using an open roll type method, among crushing methods, which enables high shear force to be added at a low temperature at the time of melting and kneading.

DESCRIPTION OF PREFERRED EMBODIMENTS

The toner used for the image forming method of the present invention comprises at least a binder resin and a coloring pigment, and is manufactured by adding, if necessary, a charge control agent, a wax, or the like thereto.

The binder resin used for the toner of the present invention may be selected from a broad range of resins including publicly known resins. Examples thereof include stylene resins such as polystylenes and stylene-acrylic ester copolymers, vinyl chloride resins, phenol resins, epoxy resins, polyester resins, polyurethane resins, and polyvinyl butyral resins, and these resisns may be used alone or in combination of two or more kinds. Further, these resins may be those in which crystalline waxes or incompatible substances have been finely dispersed in advance from the synthesis process. It is desirable that the toner comprises, in particular, a polyester resin or a polyether polyol resin as a main component, which have excellent thermal properties such as resin elasticity.

Colorants to be used for the toner of the present invention are not limited, and any conventionally known colorants can be used. Examples of yellow pigments for coloring include disazo pigments such as C. I. Pigment Yellow 17, monoazo pigments such as C. I. Pigment Yellow 74 and 97, condensed azo pigments such as C. I. Pigment Yellow 93 and 128, and benzimidazolone pigments such as C. I. Pigment Yellow 180 and 194. Examples of magenta pigments for coloring include quinacridone pigments such as C. I. Pigment Red 122 and 202, lake azo pigments such as C. I. Pigment Red 57, perylene pigments such as C. I. Pigment Red 149, 190, and 224, and naphthol-benzimidazolone pigments such as C. I. Pigment Red 184 and 185. Examples of cyan pigments for coloring include publicly known phthalocyanine pigments, but particularly C. I. Pigment Blue 15:3, C. I. Pigment blue 15:4, or the like may be exemplified. Examples of colorants for black toner include various carbon blacks.

In addition to the binder resin and the colorant, a conventionally known additive may be used for the toner of the present invention. The toner of the present invention may contain, for example, a charge control agent, a wax or the like. As the charge control agents for a color toner, colorless charge control agents are preferably used, typified by quarternary ammonium salts for positive charge and metal salts of alkylsalicylic acid for negative charge.

As a method for manufacturing the toner, a binder resin and a colorant or a master butch composition wherein a colorant is preliminarily dispersed in a binder resin as main components are dry-blended. In addition to these main components, if necessary, additional materials such as a charge control agent or a wax, or a dispersant, may be dry-blended by a blender. Thereafter, the resultant product is heat-melted and kneaded for uniform dispersion, and pulverized and classified, so that the toner of the present invention can be obtained.

Examples of mixers include Henschel-type mixers such as HENSCHEL MIXER (Mitsui Mining Co., Ltd.), Super Mixer (Kawata K. K.), and Mechanomill (Okada Seiko Co., Ltd.), and apparatuses such as Mechanofusion System (Hosokawa Micron), Hybridization System (Nara Machinery Co., Ltd.), and Cosmo System (Kawasaki Heavy Industries, Ltd.). Examples of kneading machines to be used herein include uniaxial or biaxial extruders such as TEM-100B (Toshiba Machine Co., Ltd.), PCM-65/87 (Ikegai Co.), and open roll-type kneaders such as Kneadex (Mitsui Mining Co., Ltd.). In particular, in the operation of melting and kneading, kneading with high shear at a low temperature is preferred in order not to cause excessive decrease in the viscosity of the resin at the time of melting for efficiently dispersing additives. Specifically, an open roll type apparatus is preferable.

Toner particles may be pulverized by an impact type air stream pulverizer using a jet stream, a mechanical pulverizer, or the like, and classified by a wind power or the like, thereby adjusting the particle size to a designated one.

Further, the toner of the present invention may be obtained by polymerization methods such as a suspension method, an emulsion aggregation method, and an in-liquid drying method, wherein particles are produced in an aqueous solution or a solvent.

The toner particles thus manufactured preferably have a volume average particle diameter of 3 to 10 μm and have a sharp particle size distribution. Toner particles having particle sizes that are available by a conventional pulverizing method can be used. Specifically, when a toner has a volume average particle diameter of D50, the toner is preferably adjusted to contain particles of 0.5×D50 or less and particles of 2×D50 or more in proportions of 20% by population or less and 2% by volume or less, respectively.

The toner particles may be used, depending on their usage, with the addition of an external additive such as a fluidizing agent or a charge control-surface resistivity control agent. Examples of pulverized inorganic materials to be used as additives include pulverized silica, pulverized titanium oxide, and pulverized alumina. Further, if necessary, pulverized inorganic materials are preferably treated with a treating agent such as silicone varnishes, various modified silicone varnishes, silicone oils, various modified silicone oils, silane coupling agents, silane coupling agents having functional groups, and other organic silicone compounds for the purpose of hydrophobing or charge-controlling. These treating agents may be used in combinations of two or more kinds.

As examples of other additives, fluorocarbon resin, zinc stearate, polyvinylidene fluoride, or lubricants such as silicone oil particles (containing about 40% silica) may be preferably used. In addition, fine white particles having opposite polarity to toner particles may be used in small amounts as improvers for development suitability.

EXAMPLES

Hereinafter, the present invention will be described with reference to concrete and comparative examples, but the present invention is not limited to these examples.

Example 1

A method for manufacturing toner used for the present invention will be described below.

A polyester resin as a binder resin having a glass transfer temperature Tg of 60° C. and ½ flow softening point temperature Tm of 100° C., a kneaded material in which pigments of each color have been previously kneaded and dispersed at a concentration of 40% by weight in the binder resin, and a charge control agent were inputted into a Henschel mixer, and mixed for 10 minutes, then obtaining a raw material mixture. According to the desired pigment concentration for a toner to be manufactured, respective composition materials were used in amounts to satisfy the following conditions.

In the case where a toner containing C % by weight of pigments is manufactured, input amounts of raw materials were:

| | |
|---|---|
| Binder resin polyester resin | (95-Y) parts by weight |
| Pigment kneaded material | Y parts by weight |
| Carnauba wax (softening point 83° C.) | 3 parts by weight |
| Charge control agent alkylsalicylate metal | 2 parts by weight |

It should be noted that the formula: $C/100=0.4\times Y/100$ should be satisfied.

Cyan pigment C.I. pigment blue 15-3 was used as a pigment, and the pigment concentrations in the toner were, respectively, adjusted to be 5, 10, 20, and 25 parts by weight. Then, raw material mixture samples were obtained.

The obtained raw materials were heat-melted, kneaded, and dispersed by a Kneadex MOS 140-800 (Mitsui Mining Co., Ltd.). The kneading conditions for this example were 75° C. on the supply side and 50° C. on the discharge side of a front roll, 20° C. on both supply and discharge sides of a back roll, 75 rpm for the front roll, 60 rpm for the back roll, and 10 kg/h for supply rate of the raw material. For all the samples, the temperature of the kneaded materials measured by infrared non-contact thermometers during the kneading and dispersing process was 120° C. or lower at any kneading point.

The kneaded material thus obtained was cooled and coarsely crushed, and then pulverized by a jet pulverizer. Thereafter, the obtained material was classified by wind classification. While the particle size was confirmed by a Colter Multi Sizer II, the toner powder was adjusted to have a volume average particle diameter D50 of 6.0 μm and a particle size distribution wherein particles having 0.5×D50 or less and particles having 2×D50 or more were distributed at ratios of 20% by population or less and 2% by weight or less, respectively.

100 parts by weight of the obtained toner particles were mixed with 1.0 part by weight of hydrophobic silica fine powder (BET ratio surface area 120 $m^2/g$) that was surface-treated with a silane coupling agent and dimethyl silicone oil, thereby preparing negatively friction-charged toner. Then, toners TC-1 to TC-4 were obtained, all of which had a bulk density of 0.4 $g/cm^3$ measured by a bulk density measuring instrument JID-K5101. In addition, TC-5 toner was obtained in the same manner as above except that the wax, binder resin, and pigment were present in proportions of 0 parts by weight, 78 parts by weight, and 20 parts by weight, respectively. The obtained toner had a bulk density of 0.4 $g/cm^3$. All of the obtained toners had a true specific gravity ρ of 1.1 $g/cm^3$.

The obtained toners were mixed into silicone-coated ferrite core carriers with an average particle diameter of 60 μm so that the toners had a concentration of 5% by weight, thereby providing a two-component developer. Using a copier AR-C260 (Sharp Corporation), a solid 20 mm×50 mm image was printed on a paper dedicated for full color copying (product No. PP106A4C, Sharp Corporation) so that the deposition amount of each toner was 0.3 $mg/cm^2$. Using an oilless external fixing machine having a heat fixing roller with a diameter of 40 mm and a nip width of 8 mm from a pressure roller at a process speed of 117 mm/sec, an image for evaluation fixed by the heat roller with a surface temperature of 150° C. was prepared.

The thickness of the toner layer of the prepared sample image on the surface of the paper was measured by embedding the sample image into the resin, cutting it into thin pieces with a thickness of about 200 μm in such manner that a microtome cuts across an image cross-section in a direction perpendicular to the paper face, and observing the pieces at 500-fold magnification with a transmission optical microscope. The thicknesses were measured at about 20 points and the average thereof was used as the thickness of the toner layer.

The fixing strength in the sample image was evaluated by the following fixability test. The paper was folded so that the printing surface was on the inside and a 850 g roller was rolled back and forth while applying constant pressure to give a load. Then, the toner layer on the printing surface of the folded portion in a boundary part was scrubbed and swept 5 times with a designated brush. Herein, the line width created in the folded portion was visually observed for evaluation and classified into the following 3 levels.

Good: the width was very narrow, less than about 0.3 mm and the toner layer was well melted and fixed.

Acceptable: the width was about 0.5 mm and no problem was found for practical use.

Poor: the width was wide and disturbed and the toner layer was not fixed.

In addition, the optical density of the image sample was measured by a spectro densitometer X-Rite 938, and an image sample with an optical density of 1.4 or more was determined to be good.

Comparative Example 1

A toner TC-6 having a true specific gravity ρ of 1.1 g/cm$^3$ and a bulk density of 0.4 g/cm$^3$ was obtained in the same manner as that in Example 1 except that the pigment concentration of the toner composition was 3 parts by weight.

The obtained toner was evaluated in the same manner as that in Example 1, and there were problems in that the thickness of the toner layer was excessively thin and the optical density on the paper surface was insufficient.

Comparative Example 2

A toner TC-7 having a true specific gravity ρ of 1.1 g/cm$^3$ and a bulk density of 0.4 g/cm$^3$ was obtained in the same manner as that in Example 1 except that the toner contained wax, binder resin, and pigment in proportions of 0, 73, and 25 parts by weight, respectively.

The obtained toner was evaluated in the same manner as that of Example 1 and there were problems in that the toner layer was excessively thick, the toner layer was inadequately melted, and the toner had a poor fixing strength.

Example 2

Toners TY-1 and TM-1 having a bulk density of 0.4 g/cm$^3$ were obtained in the same manner as that of Example 1 except that the toners contained yellow pigment C.I. pigment yellow 74 and magenta pigment C.I. pigment red 122 in proportions of 10 parts by weight, respectively.

The obtained toners had a true specific gravity ρ of 1.1 g/cm$^3$. These toners were evaluated in the same manner as that in Example 1 and good results therefor were obtained.

When the yellow toner and the magenta toner had optical densities of 1.1 or more and 1.2 or more, respectively, which were measured with a spectro densitometer X-Rite 938, they were determined to be good.

Table 1 shows the pigment concentrations, image heights, optical densities, and fixability of Examples 1 and 2 and Comparative Examples 1 and 2.

TABLE 1

| | Sample | Pigment conc. (% by weight) | Image height h (μm) | Optical conc. | Fixability |
|---|---|---|---|---|---|
| Example 1 | TC-1 | 5 | 2.7 | 1.48 | good |
| | TC-2 | 10 | 4.6 | 1.77 | good |
| | TC-3 | 20 | 6.3 | 1.73 | good |
| | TC-4 | 25 | 7.4 | 1.54 | good |
| | TC-5 | 20 | 7.5 | 1.64 | acceptable |

TABLE 1-continued

| | Sample | Pigment conc. (% by weight) | Image height h (μm) | Optical conc. | Fixability |
|---|---|---|---|---|---|
| Comparative Example 1 | TC-6 | 3 | 2.2 | 1.28 | good |
| Comparative Example 2 | TC-7 | 25 | 9.3 | 1.53 | poor |
| Example 2 | TY-1 | 10 | 5.5 | 1.25 | good |
| | TM-2 | 10 | 5.8 | 1.43 | good |

According to the results of Table 1, when the image height and pigment concentration were controlled within designated ranges, it was found that a smaller amount of toner could provide a sharp, high-density image.

Example 3

Toners TC-8 to TC-10 having a true specific gravity of 1.1 g/cm$^3$ and a bulk density of 0.4 g/cm$^3$ were obtained in the same manner as that of Example 1 except that the toners contained polyester resins having a Tg of 60° C. but ½ flow softening temperatures of 89° C., 100° C., and 123° C., respectively, as binder resins and cyan pigment C.I. Pigment Blue 15-3 was present in a proportion of 10 parts by weight.

The obtained toners were evaluated in the same manner as that of Example 1 and the measurement of 1/2 flow softening point temperature and the storage stability test were also carried out. All examples showed good results.

The measurement of 1/2 flow softening point temperature was conducted using a capillary type flow tester CFT-500 (Shimadzu Corp.), and a temperature at which a half of the sample flowed out was designated as a softening point (sample: 1 g, rising temperature speed: 6° C./min., load 20 kg/cm$^2$, nozzle: 1 mmϕ×1 mm). Further, the storage stability test was carried out in the following manner. 150 g of the obtained toner was sealed in a 500-ml bottle and was left for 48 hours in a constant temperature bath with a temperature of 50° C. After being cooled for 8 hours at room temperature, the toner was passed through a mesh having a sieve opening of 100 μm using a low tap. When the amount of toner left on the mesh was 1 g or less, the toner was determined to be good.

Table 2 shows the ½ flow softening point temperatures, pigment concentrations, image heights, optical densities, fixability, and storage stability of Example 3.

TABLE 2

| | Sample | Toner 1/2 softening point temp. (° C.) | Pigment conc. (% by weight) | Image height h (μm) | Optical density | Fixability | Storage stability |
|---|---|---|---|---|---|---|---|
| Examples 3 | TC-8 | 95 | 10 | 3.9 | 1.72 | good | good |
| | TC-9 | 107 | 10 | 4.6 | 1.77 | good | good |
| | TC-10 | 130 | 10 | 5.8 | 1.67 | good | good |

EFFECT OF THE INVENTION

According to the present invention, the thickness of a toner image, which is formed and fixed on a printing medium, is controlled within a designated range and the pigment concentration in the toner and melting characteristics of the toner are properly designed, thereby enabling the obtainment of a sharp, high-density image with a smaller amount of toner. This allows sufficient image density and color reproduction with no influence of a printing surface at the time of forming the image. Therefore, it becomes possible to form a high-density image having almost the same evenness as that formed by surface printing and a sharp image with a smaller amount of toner.

What is claimed is:

1. A image-forming method using electrophotography, wherein an image of a monochromatic solid part is formed with the deposit amount (M) of a toner on a printing medium, and the image after fixation on the printing medium has a toner layer thickness (h) that satisfies the following equation:

$$10\ M/\rho \leqq h \leqq 10\ M/A$$

wherein M represents the toner deposition amount (mg/$cm^2$) on the printing medium and is 0.4 or less, h represents the toner layer thickness (μm) of the image after fixation on the printing medium, ρ represents a true specific gravity (g/$cm^3$) of the toner, and A represents a bulk density (g/$cm^3$) of the toner.

* * * * *